US006808107B2

(12) United States Patent
Jackson

(10) Patent No.: US 6,808,107 B2
(45) Date of Patent: Oct. 26, 2004

(54) ECONOMICAL, STACKABLE CONTAINER FOR RETAIL GOODS

(75) Inventor: Keith A. Jackson, Gurnee, IL (US)

(73) Assignee: Packaging Corporation of America, Lake Forest, IL (US)

( * ) Notice: Subject to any disclaimer, the term of this patent is extended or adjusted under 35 U.S.C. 154(b) by 10 days.

(21) Appl. No.: 09/902,197

(22) Filed: Jul. 10, 2001

(65) Prior Publication Data

US 2003/0010816 A1 Jan. 16, 2003

(51) Int. Cl.[7] ..... B65D 5/00

(52) U.S. Cl. ..... 229/169; 229/170; 229/101; 229/165; 229/123; 229/939; 229/918

(58) Field of Search ..... 229/169, 170, 229/101, 165, 123, 939, 16

(56) References Cited

U.S. PATENT DOCUMENTS

| | | | | | |
|---|---|---|---|---|---|
| 1,125,535 | A | * | 1/1915 | Hoffman | 229/101 |
| 2,130,445 | A | * | 9/1938 | Bemiss | 229/939 X |
| 2,407,111 | A | * | 9/1946 | Thompson | 229/117.12 |
| 2,450,035 | A | * | 9/1948 | De Mian | 229/126 |
| 2,652,185 | A | * | 9/1953 | Acker | 229/169 |
| 2,942,770 | A | * | 6/1960 | Eichorn | 229/101 |
| 2,983,424 | A | * | 5/1961 | Glass | 229/121 |
| 3,111,254 | A | * | 11/1963 | Thyen | 229/101 |
| 3,306,516 | A | * | 2/1967 | Taylor, Jr. | 229/131 |
| 3,669,341 | A | * | 6/1972 | Hughes | 229/125 |
| 3,820,706 | A | | 6/1974 | Gibson et al. | |
| 3,863,831 | A | | 2/1975 | Wozniacki et al. | |
| 3,869,077 | A | * | 3/1975 | Tuura | 229/117.16 |
| 3,871,570 | A | | 3/1975 | Garmon | |
| 3,910,484 | A | | 10/1975 | Wozniacki | |
| 3,910,487 | A | | 10/1975 | Jaeschke | |
| 3,940,053 | A | | 2/1976 | Putman et al. | |
| 4,053,098 | A | * | 10/1977 | Baptist | 206/506 |
| 4,053,100 | A | | 10/1977 | Baptist | |
| 4,082,215 | A | | 4/1978 | Eichenauer | |
| 4,101,048 | A | | 7/1978 | Rieben et al. | |
| 4,117,929 | A | | 10/1978 | VanderMey | |
| 4,121,753 | A | | 10/1978 | Westfall | |
| 4,151,948 | A | | 5/1979 | de la Fuente, Jr. | |
| 4,170,297 | A | | 10/1979 | Johnson | |
| 4,175,691 | A | | 11/1979 | Cornell et al. | |
| 4,185,741 | A | | 1/1980 | Schiff et al. | |
| 4,191,288 | A | | 3/1980 | Hostad | |
| 4,228,898 | A | | 10/1980 | Zeitter et al. | |
| 4,234,081 | A | | 11/1980 | Champlin | |
| 4,284,195 | A | | 8/1981 | Champlin | |
| 4,291,830 | A | | 9/1981 | Sorensen | |
| 4,300,680 | A | | 11/1981 | Champlin | |
| 4,304,351 | A | | 12/1981 | Stollberg | |
| 4,323,188 | A | * | 4/1982 | Dickerson | 229/121 |
| 4,324,328 | A | | 4/1982 | Champlin | |
| 4,335,843 | A | | 6/1982 | Kent | |
| 4,347,969 | A | | 9/1982 | Kost et al. | |
| 4,349,147 | A | | 9/1982 | Jensen | |
| 4,385,721 | A | | 5/1983 | Olsen et al. | |

(List continued on next page.)

FOREIGN PATENT DOCUMENTS

| | | |
|---|---|---|
| FR | 2728867 A1 | 12/1994 |
| WO | 99/43560 | 9/1999 |

OTHER PUBLICATIONS

PCT Search Report for International Application PCT/US02/20819 dated Sep. 13, 2002.

*Primary Examiner*—Tri M. Mai
(74) *Attorney, Agent, or Firm*—Jenkens & Gilchrist

(57) ABSTRACT

A container for transporting meat, produce, and other goods contains a bottom wall, side walls, and end walls. The end walls include hinged platform structures movable between a closed position and an open position. The closed position enables stable stacking of multiple containers and the open position allows easy access to the interior of the container for loading and unloading. The hinged platforms further add stability to the container walls when in the closed position.

20 Claims, 7 Drawing Sheets

U.S. PATENT DOCUMENTS 4,391,405 A 7/1983 Drinon
4,418,863 A 12/1983 Kimbrell, Sr.
4,441,649 A 4/1984 Nederveld
4,511,080 A 4/1985 Madsen et al.
4,526,317 A 7/1985 Cassidy
4,537,344 A 8/1985 Thomas
4,567,996 A 2/1986 Muise
4,570,790 A 2/1986 Turnage
4,600,142 A 7/1986 Quaintance
4,613,045 A 9/1986 Watson
4,645,122 A 2/1987 Nederveld
4,676,429 A 6/1987 Crowe et al.
4,770,339 A 9/1988 Weimer
4,787,515 A 11/1988 Stoll
4,852,756 A 8/1989 Holladay
4,883,221 A * 11/1989 Brundage ..... 229/143
4,884,739 A 12/1989 Nederveld
4,884,741 A 12/1989 Nederveld
4,946,093 A 8/1990 Moorman
4,949,898 A 8/1990 Nederveld
5,000,377 A 3/1991 McClure
5,002,224 A 3/1991 Muise
5,052,615 A 10/1991 Ott et al.
5,125,567 A 6/1992 McClure
5,139,196 A 8/1992 Fry et al.
5,163,609 A 11/1992 Muise, Jr.
5,183,202 A * 2/1993 Love ..... 229/123
5,261,594 A 11/1993 Brown et al.
5,263,612 A 11/1993 Nederveld
5,277,360 A 1/1994 DeMott
5,285,956 A 2/1994 Piepho
5,289,970 A 3/1994 McClure
5,294,044 A 3/1994 Clark
5,330,094 A 7/1994 Mertz
5,333,777 A * 8/1994 Roth ..... 229/117.16
5,361,975 A 11/1994 Droste et al.
5,361,976 A 11/1994 Blomfield
5,370,303 A 12/1994 Fry
5,386,937 A 2/1995 Crawford
5,392,985 A 2/1995 Smith et al.
5,429,296 A 7/1995 Southwell et al.
5,458,272 A 10/1995 Ward-Weber
5,458,283 A 10/1995 Southwell et al.
5,499,764 A * 3/1996 Carlsson ..... 229/117.16
5,516,034 A 5/1996 Jensen et al.
5,535,941 A 7/1996 Garza
5,649,663 A 7/1997 Pestow, Jr.
5,673,848 A 10/1997 Garza
5,687,902 A 11/1997 Tusing et al.
5,704,193 A 1/1998 Roe et al.
5,752,597 A 5/1998 Brangle, Jr.
5,860,590 A 1/1999 Blomfield et al.
6,286,753 B1 9/2001 Jackson et al.
6,302,323 B1 10/2001 Southwell

* cited by examiner

ECONOMICAL, STACKABLE CONTAINER FOR RETAIL GOODS

FIELD OF THE INVENTION

The present invention relates generally to containers for retaining, protecting, and displaying produce and other retail goods and making such containers. More particularly, the present application relates to a low-cost, single-blank retail goods container having hinged platforms which are easily movable between closed and open positions.

BACKGROUND OF THE INVENTION

Flat sheets of corrugated fiberboard or paperboard, typically referred to as blanks, have been used for many years as the starting material to form containers. For ease of description, corrugated fiberboard will be used by way of example, but paperboard is also contemplated. Corrugated fiberboard generally refers to a multi-layer sheet material comprised of two sheets of liner bonded to a central corrugated layer of medium. Given a basic size requirement specified by the customer, industry standards, and the preference for low cost, fiberboard container manufacturers strive to provide structural stacking strength with a minimal amount of corrugated fiberboard. A typical well-known container is a single piece tray design having a bottom wall, two side walls, and two end walls each hinged to the bottom wall. Typically, a single piece of corrugated fiberboard will be cut and scored to form a flat blank that will then be erected into this container.

Typical containers for the support and transport of food articles and other retail goods are corrugated containers having fixed configurations. These containers must be filled, stacked, transported, and later unstacked on-site for display or storage purposes. One method of facilitating the stacking of containers is to provide shoulders or platforms partially covering the top openings of the containers. While this approach makes it easier to stack boxes without the boxes falling into each other (i.e., "nesting"), it has the negative result of making the container more difficult to load and unload. Further, there is a direct relationship between the coverage of the stacking platform and improved stacking ability, but there is also a direct relationship between the coverage of the platform and the difficulty of loading and unloading the container.

A packed container of produce or retail goods will generally hold a weight suitable for handling by an individual. Such containers will be generally rectangular and have variable dimensions. Further, these containers will normally be stacked for transport and storage. The cost of labor, in the form of the time required to handle the produce and to assemble the shipping containers, can be a significant factor in the overall cost of the produce. Many current containers can only be assembled by hand, a method that is costly and time consuming. Assembling fiberboard containers for setup by a machine where cooperating adjoining fiberboard sections are adhesively bonded to form the container can reduce cost and time.

It is important in the production, distribution, and sale of perishable and nonperishable articles, such as produce and case ready meat products, that the articles are safely, economically, and conveniently stored for transport and safely and securely shipped for sale. Safe and secure storage and shipping is particularly a problem if heavy items must be placed in containers that are stacked upon each other. Stackable meat and containers often acquire, for example, bulging side or end walls, deformed bottom walls, or smashed corners that damage the produce due to, for example, the weight or movement of the produce during shipment. Further, if the environment in which the fiberboard container is shipped or stored is refrigerated, the moisture present in a refrigerated environment is likely to be absorbed by and weaken the container. Thus, it is important to ensure that maximum stability is maintained in a container throughout the shipping process so that a container holds up to forces on the container from goods packaged in the container, from other containers stacked atop the container, and from general handling of the container.

Once the food product reaches a retail destination, the product is removed from the container and put on sale for use. Removing the food from the container is time consuming. This can be especially difficult if the container has platforms partially covering the top of the container and the person unloading the container must reach around the platforms to get to the food products.

Thus, it is desirable to provide a container for transporting goods that is both durable and secure to prevent corrugation failure and damage to contents, and yet is easily stacked, loaded, and unloaded.

SUMMARY OF THE INVENTION

According to one embodiment of the present invention, a container is provided which is economical to manufacture and easy to stack and which also provides easy access to space within the container for purposes of loading and unloading the container.

According to one embodiment of the present invention, a container is provided with hinged platforms which are movable between closed positions, wherein the platforms make it easy to stack containers atop one another, and opened positions, wherein the hinged platforms do not impede access to the interior of the container and the container is easily loaded and unloaded.

According to another embodiment of the present invention, a container is provided with corner reinforcement flaps which strengthen container side walls to prevent nesting and container failure.

BRIEF DESCRIPTION OF THE DRAWINGS

Other objects and advantages of the invention will become apparent upon reading the following detailed description and upon reference to the drawings.

Figure 1:
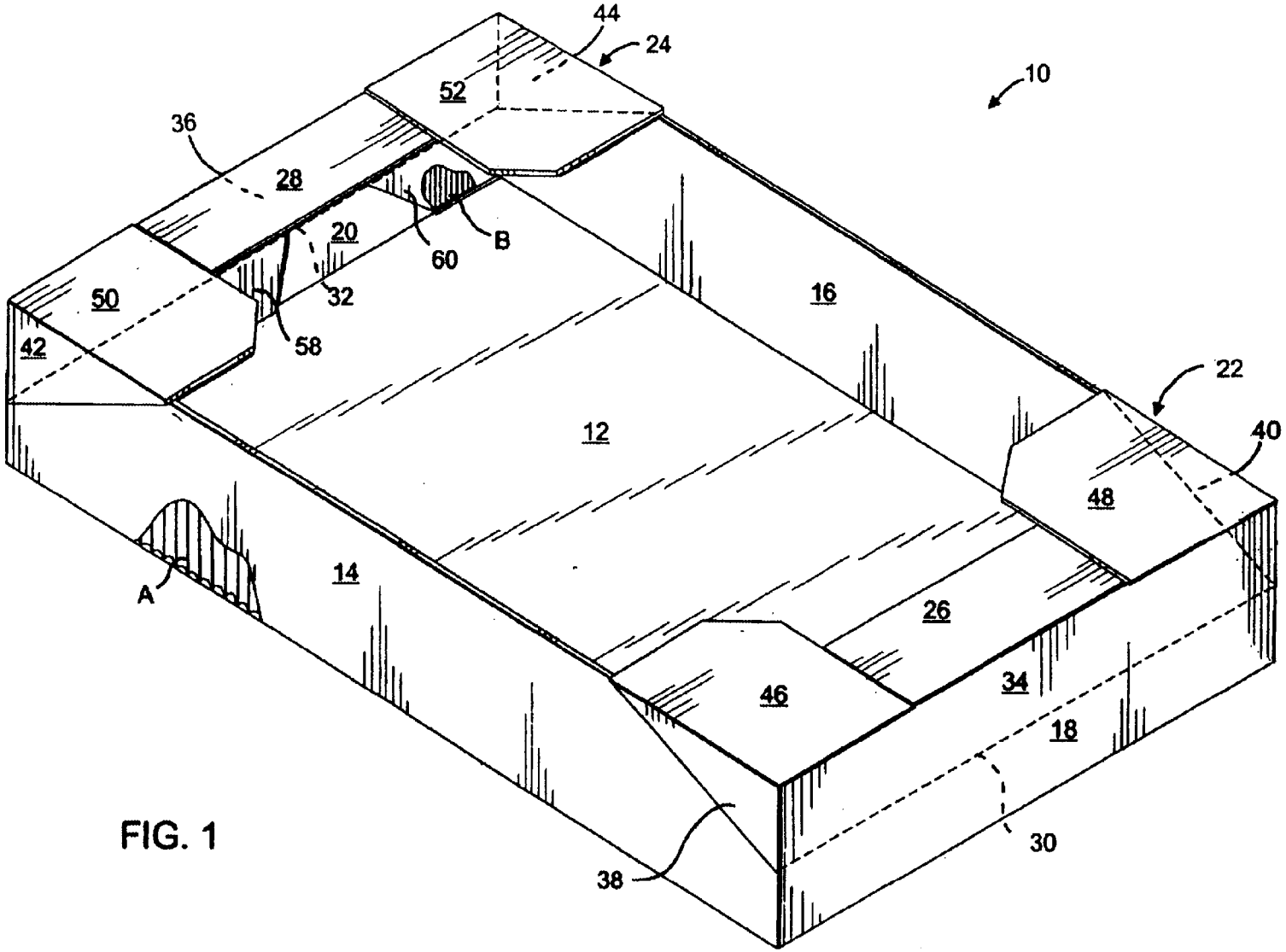
FIG. 1 is a perspective view of a stackable container embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed but, on the contrary, the intention is to cover all modifications, equivalents, and alternatives falling within the spirit and scope of the invention as defined by the appended claims.

DETAILED DESCRIPTION OF THE INVENTION

A successful design for a container must overcome many obstacles to achieve superior performance. A container must be inexpensive and easy to assemble. At the same time, a container must have tremendous structural integrity to prevent damage to primary packaged goods that could occur if the container were to collapse. This structural integrity must be maintained against forces encountered when containers are stacked and transported. Further, the containers must be easy to stack atop one another and, when stacked, the containers must retain great stacking strength and stability. A container may incorporate holes in its side walls to allow for access holes and airflow vents. In some applications, is also desirable for a container to be displayable to consumers at stores and to allow for the greatest amount of goods to be contained within the container while using a limited amount of material.

In the past, attempted solutions to these problems have led to their own resultant problems, since solving one problem often exacerbates another. For example, corner structures that increase stacking strength commonly include elements that protrude into the container, reducing the amount of goods or rectilinear primaries the container can hold and making it more difficult to load and unload the container.

Finally, even containers that feature acceptable stacking strength and structural integrity often encounter the problem of nesting. Nesting arises when a stacked container falls into a lower container. This may arise when the walls of a lower container bulge or when stacking tabs misalign slightly, leaving the upper container free to be jostled about during shipment. Nesting can result in goods in a lower container being crushed by the stacked container. If lower containers in a stack become nested unevenly, an entire stack of containers can topple. The problem of nesting has been dealt with in the past by using platforms or shoulders extending across container openings, but these platforms or shoulders make containers more difficult to load and unload.

An economical, stackable container 10, as shown in FIG. 1, is a preferred embodiment of the present invention, solving the problems described above in an easily-assembled solution. The container 10 is preferably constructed of corrugated fiberboard but it will be appreciated that the container 10 could alternatively be constructed of solid fiber board, heavy fiberboard, heavy plastic sheeting, or other suitable rigid construction materials. The container 10 includes a bottom panel 12, first and second side panels 14, 16, and first and second end panels 18, 20, which serve to form the basic structure of the container 10. The first and second side panels 14, 16 may be longer, shorter, or the same size as the first and second end panels 18, 20 depending on the desired use of the container 10.

The end panels are provided with first and second hinged platform structures 22, 24 having first and second top platforms 26, 28. The first and second hinged platform structures 22, 24 are movable from closed positions, as shown in FIG. 1, to open positions to allow for easy loading and unloading of the container 10. Movement of the first and second hinged platform structures 22, 24 between the closed positions shown in FIG. 1 and the open positions is enabled by first and second hinges 30, 32 which respectively connect the first and second hinged platform structures 22, 24 to the first and second end panels 18, 20. First and second end folding flaps 34, 36 are respectively positioned between the first and second hinges 30, 32 and the first and second top platforms 26, 28. The hinges 30, 32 are preferably offset from a top of said container to allow the hinged platform structures 22, 24 to be easily moved into open positions, uncovering the entire opening at the top of the container 10.

It is important that the container 10 retain structural integrity and anti-nesting properties during loading, shipping, and unloading of the container 10. Structural integrity can be maintained through the use of vertical fluting in support surfaces as well as through the use of reinforcing members, and anti-nesting properties are primarily maintained through the positioning of the top platforms 26, 28 in their closed positions. The overall strength of the container 10 and the proper positioning of the top platforms 26, 28 are both enhanced by the use of side reinforcement flaps. First and second side reinforcement flaps 38, 40 are integral with the first hinged platform structure 24 and extend from the first top platform 26 to the first end folding flap 34. Third and fourth side reinforcement flaps 42, 44 extend from the second top platform 28 to the second end folding flap 36.

Corner integrity and the stacking platform is further enhanced through the use of first, second, third, and fourth minor platform panels 46, 48, 50, 52. The minor platform panels 46, 48, 50, 52 may be formed from panels connected, respectively, to the first, second, third, and fourth side reinforcement flaps 38, 40, 42, 44, and they serve to add structural stability to the hinged platform structures 22, 24 and further to hold the side reinforcement flaps 38–44 in upright positions to assure their continued integrity. The minor platform panels 46–52 may be adhesively connected to the top platforms 26, 28. In some embodiments, the minor platform panels 46–52 are connected to the top of the top platforms 26, 28 while, in other embodiments, the minor platform panels 46–52 are connected to the bottom of the top platforms 26, 28. Instead of using an adhesive, the minor platform panels 46–52 may be connected to the top platforms 26, 28 via a punch-through connector without the need for adhesive. Punch-through connectors may include connectors, such as staples or a connection style of punching through the minor platform panels 46–52 and the top platforms 26, 28, and folding over the punched out section of material.

The overall strength of the container 10 is also improved through the use of multiple plies of material along walls of the container 10. For example, first, second, third, and fourth minor interior wall flaps 54, 56, 58, 60 may be used to enhance the stability of the first and second end panels 18, 20 (due to perspective, first and second minor interior wall flaps 54, 56 are not visible in FIG. 1). Alternatively, minor interior wall flaps may be provided on the side panels 14, 16.

The strength of the container 10 against stresses applied from outside is enhanced through the maximization of vertical fluting in the construction. Vertical fluting refers to the pattern of corrugated construction running in a vertical direction along support walls, and a container which employs vertical fluting is stronger against vertically directed forces than containers having fluting in other directions. As shown by the cutaway "A" in FIG. 1, the side walls 14, 16 have vertically fluted corrugated fiberboard in a preferred embodiment. Further, as shown by cutaway "B" in FIG. 1, vertical fluting is also employed in the minor interior wall flaps 54, 56, 58, 60. The use of vertical fluting in the side walls, vertical fluting in the minor interior wall flaps, and multiple plies of material along at least portions of the end walls results in a sturdy container which is resistant to deformation or failure as a result of stacking or other outside forces encountered during loading, shipping, and unloading.

Figure 2:
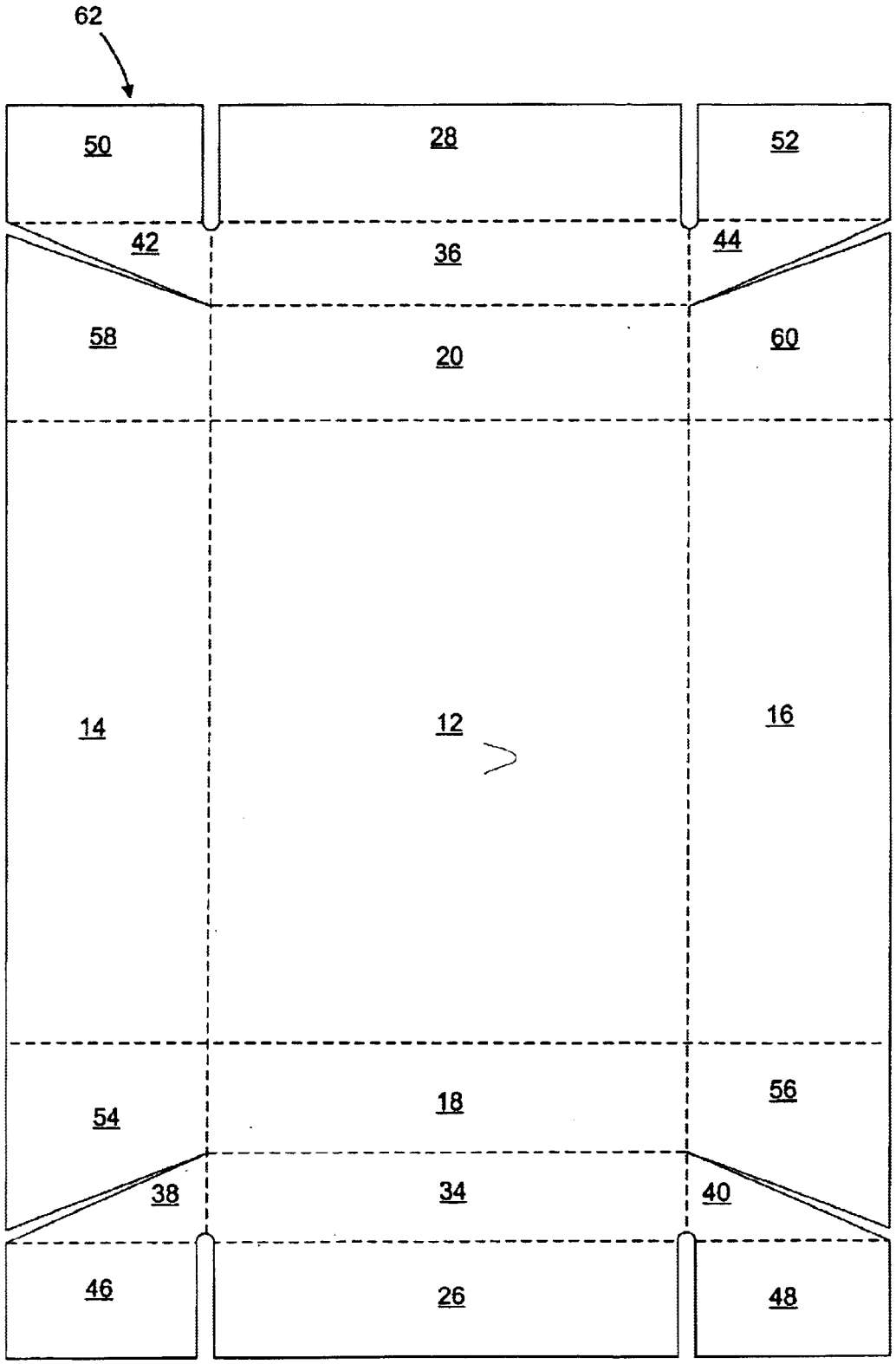
FIG. 2 is a plan view of the inner surface of a blank for forming the stackable container in FIG. 1.

The container 10 is preferably easily and economically manufactured from a single blank. Turning now to FIG. 2, a plan view for a blank 62 for assembling the container 10 is shown. The blank 62 is preferably rectangular in shape, with a variety of cuts and creases or scores enabling the construction of the container 10. Cuts are represented in FIG. 2 with solid lines, while creases or scores are represented by dotted lines.

Figure 3:
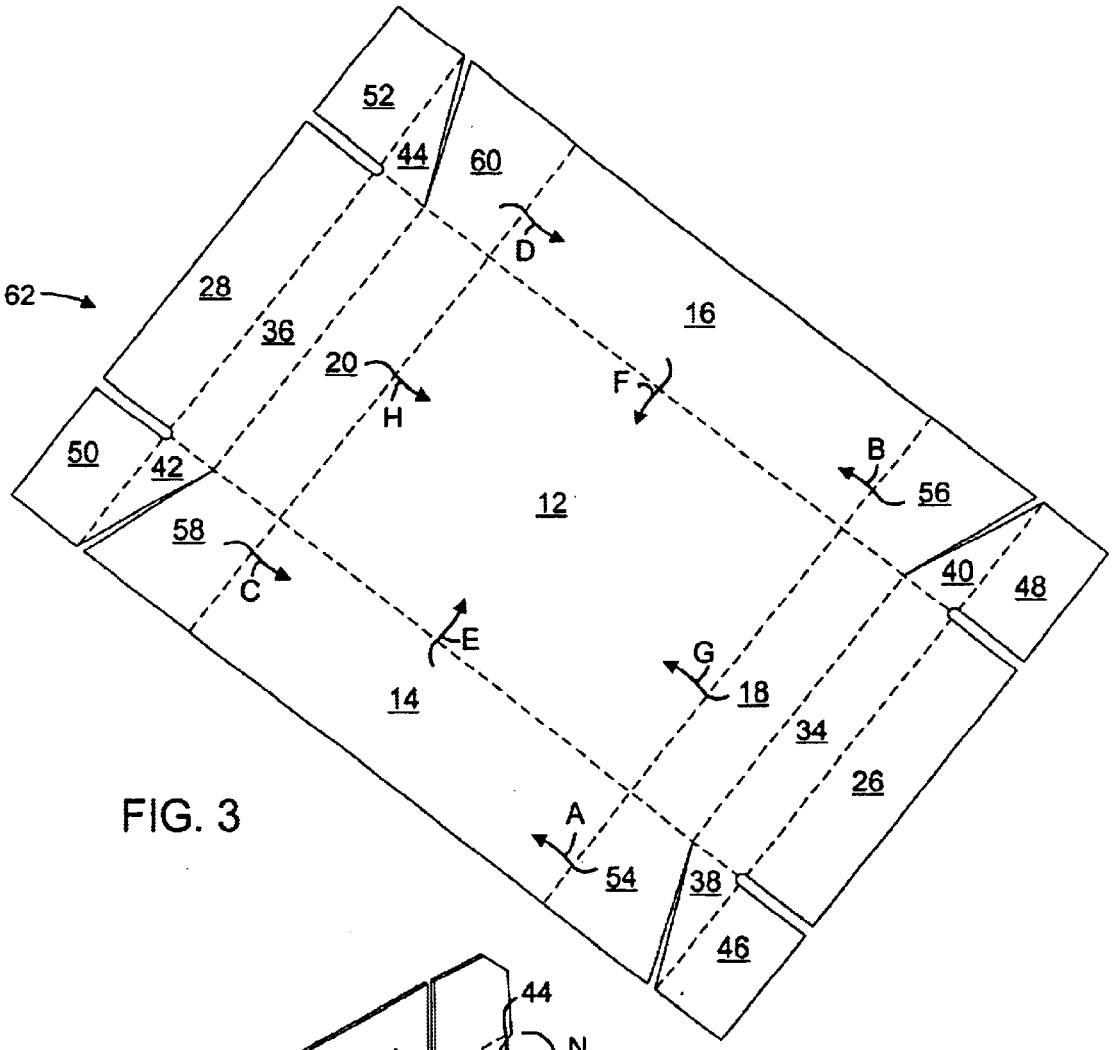
FIGS. 3–5 are perspective views illustrating a sequence in which the panels of the blank in FIG. 2 are folded to form the stackable container in FIG. 1.

Continuing to FIG. 3, the blank 62 is shown in a perspective view to demonstrate how the container 10 is constructed from the blank 62. The minor interior wall flaps 54, 56, 58, 60 are folded upwardly as shown, respectively, by arrows "A," "B," "C," and "D," and the side panels 14, 16 are folded upwardly as shown, respectively, by arrows "E" and "F." These folds preferably result in the first and second side panels 14, 16 being approximately orthogonal to the bottom panel 12. The end panels 18, 20 are folded upwardly as shown, respectively, by arrows "G" and "H." These folds result in the formation shown in FIG. 4.

Figure 4:
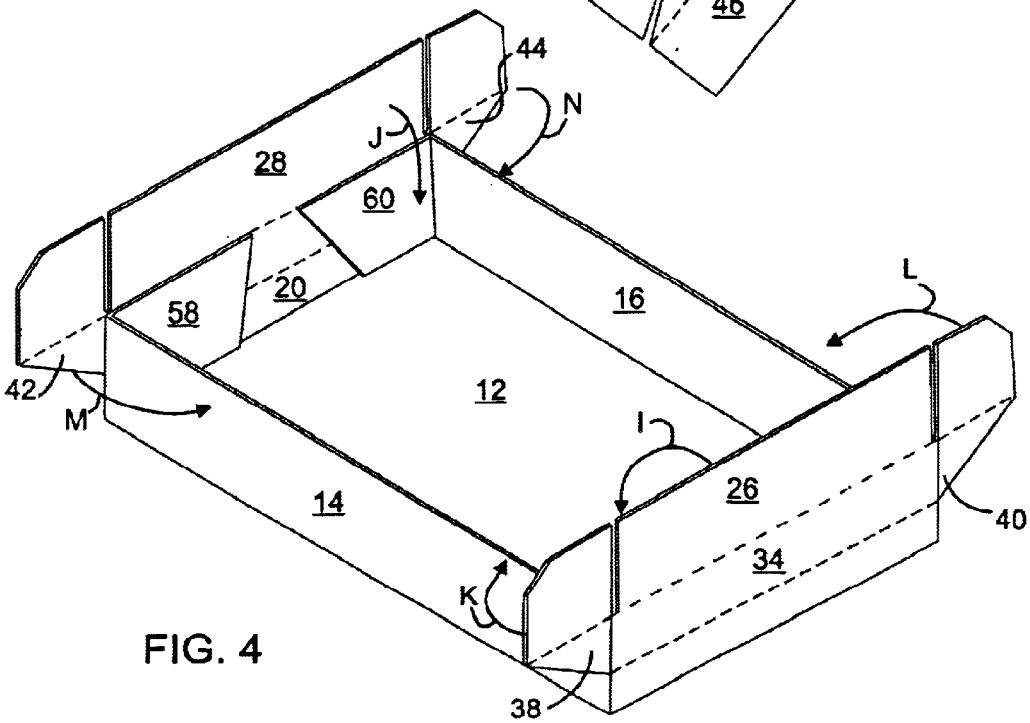
Figure 5:
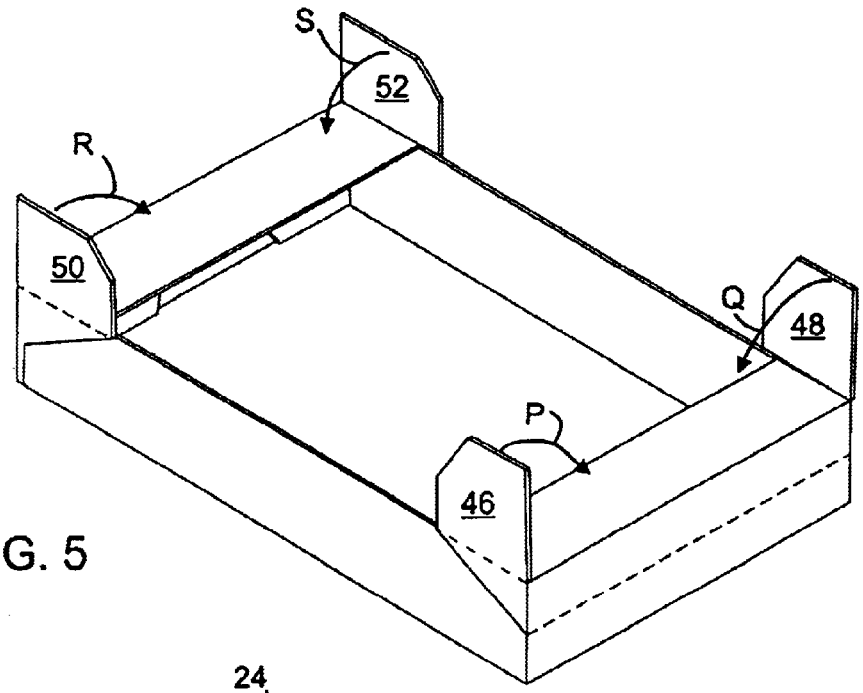

Next, as illustrated in FIG. 4, the first and second top platforms 26, 28 are folded downwardly as shown, respectively, by arrows "I" and "J," resulting in the top platforms 26, 28 being roughly parallel to the bottom panel 12. Next, the side reinforcement flaps 38, 40, 42, 44 are folded inwardly as shown, respectively, by the arrows "K," "L," "M," and "N" into contact with their corresponding side panels 14, 16. These folds result in the formation shown in FIG. 5. To complete formation of the container 10, the minor platform panels 46, 48, 50, 52 are folded inwardly as shown, respectively, by the arrows "P," "Q," "R," and "S" to result in the container 10 shown in FIG. 1. Though one folding order has been shown, it will be understood that other folding patterns will result in the formation of a similar container 10 from the blank 62.

Figure 6:
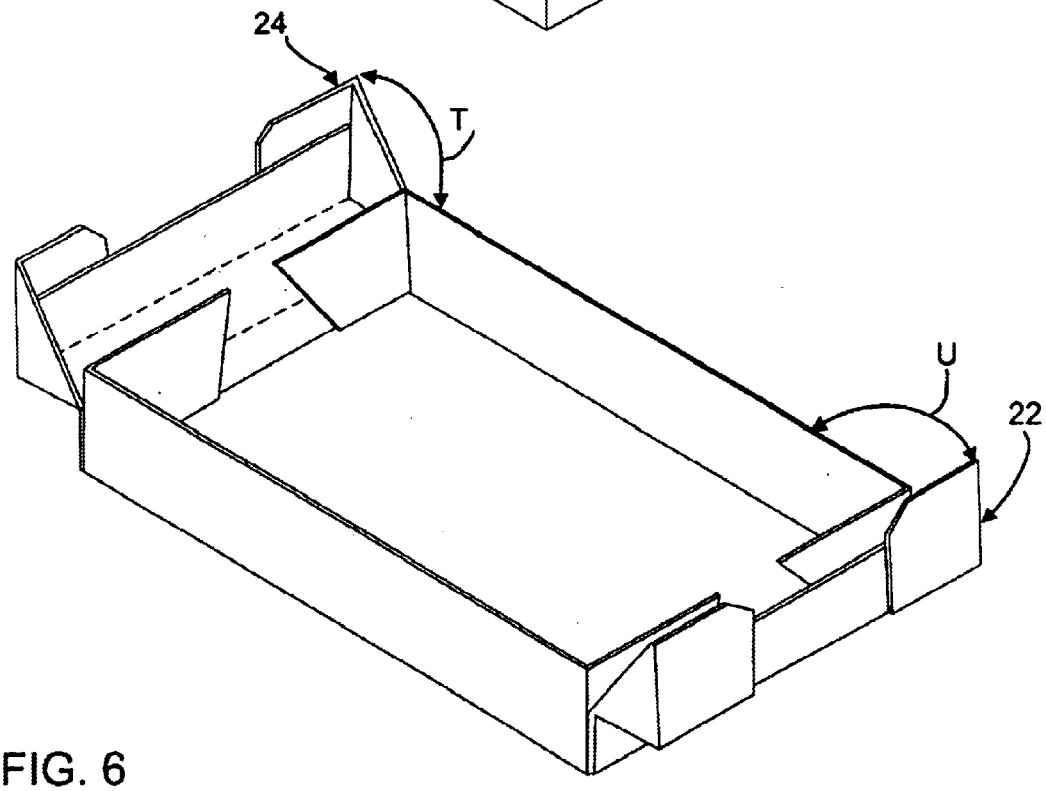
FIG. 6 is a perspective view of a container according to the present invention having hinged platform structures in open positions.

Turning now to FIG. 6, the container 10 is shown with the hinged platform structures 22, 24 in their open positions. Double-ended arrows "T" and "U" illustrate how the hinged platform structures 22, 24 are movable between the closed positions shown in FIG. 1 and the open positions shown in FIG. 6.

Figure 7:
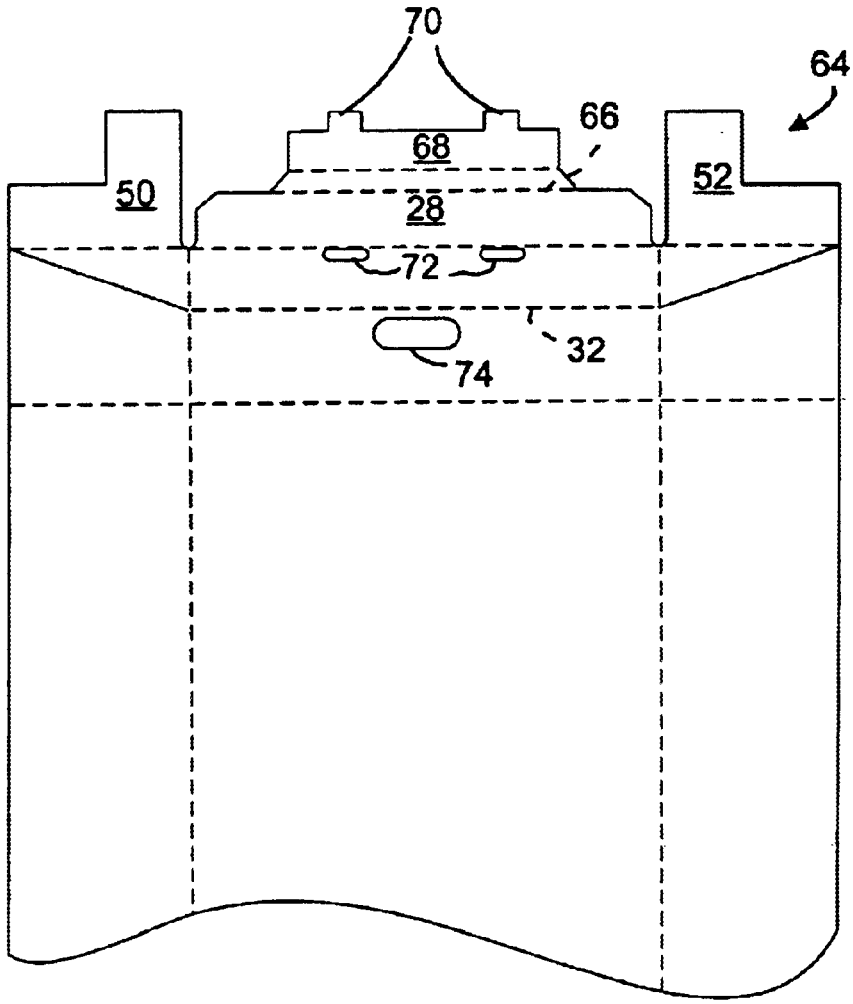
FIG. 7 is a detail plan view of a blank structure used in an alternative embodiment of the present invention.

Several alternative structures may make use of the principles of the present invention. For example, FIG. 7 shows a detail of an alternative blank structure 64 in which the minor platform panels 50, 52 and the top platform 28 have been altered to allow for non-glued platform formation. In this embodiment, the alternative blank structure 64 uses rollover scores 66 to allow a rollover panel 68 to be folded into a double thickness for the top of the resulting hinged platform structure. In this embodiment, the rollover panel 68 is folded over during container formation so that rollover tabs 70 insert into rollover tab receptacles 72. In this and other embodiments, a handhold cutout 74 may be positioned below the hinge 32 for easy carrying after the container 10 is formed.

Figure 8:
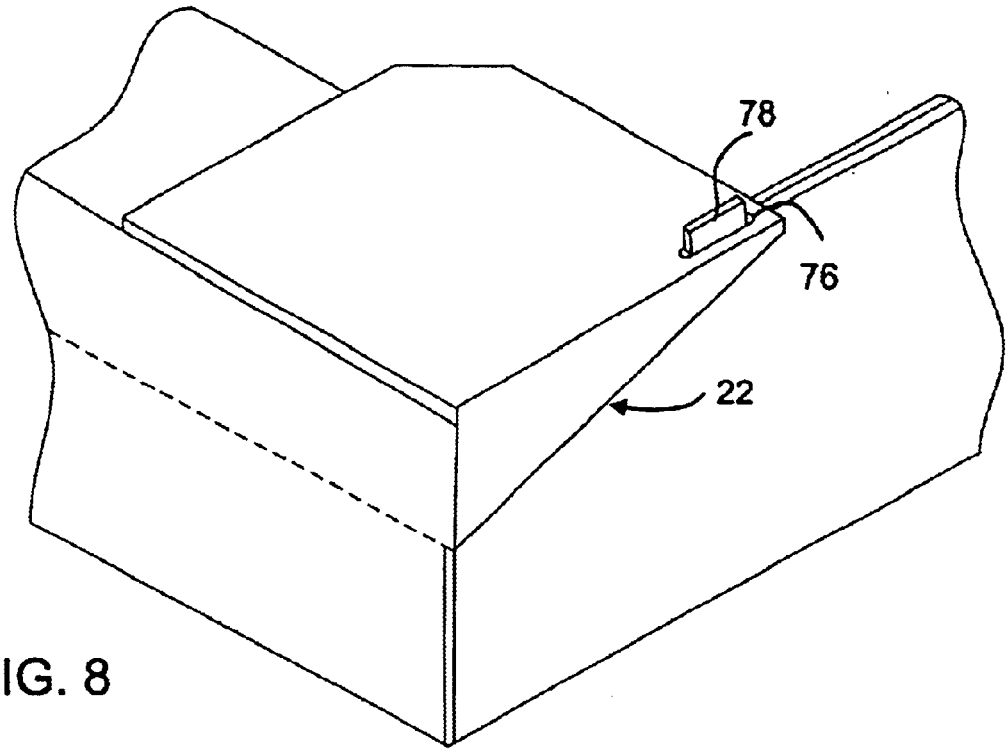
FIG. 8 is a perspective detail view of an alternative hinged platform structure for use in another alternative embodiment of the present invention.

Turning now to FIG. 8, another alternative hinged platform structure is shown. The hinged platform structure of FIG. 8 includes a stacking tab cutout 76 for accepting a stacking tab 78. The stacking tab 78 may be a simple extension of the side panel 14, or it may be a partial panel rollover tab as disclosed in U.S. patent application Ser. No. 09/693,387, entitled "Produce Container And Method For Making The Same," filed on Oct. 20, 2000, and assigned to the assignees of the present application, which is incorporated herein by reference in its entirety. The hinged platform structure may also include a full panel rollover tab as well. This formation increases the stability of the hinged platform structure 22 and also makes it possible to more positively hold the stacking platform in the closed position.

Figure 9:
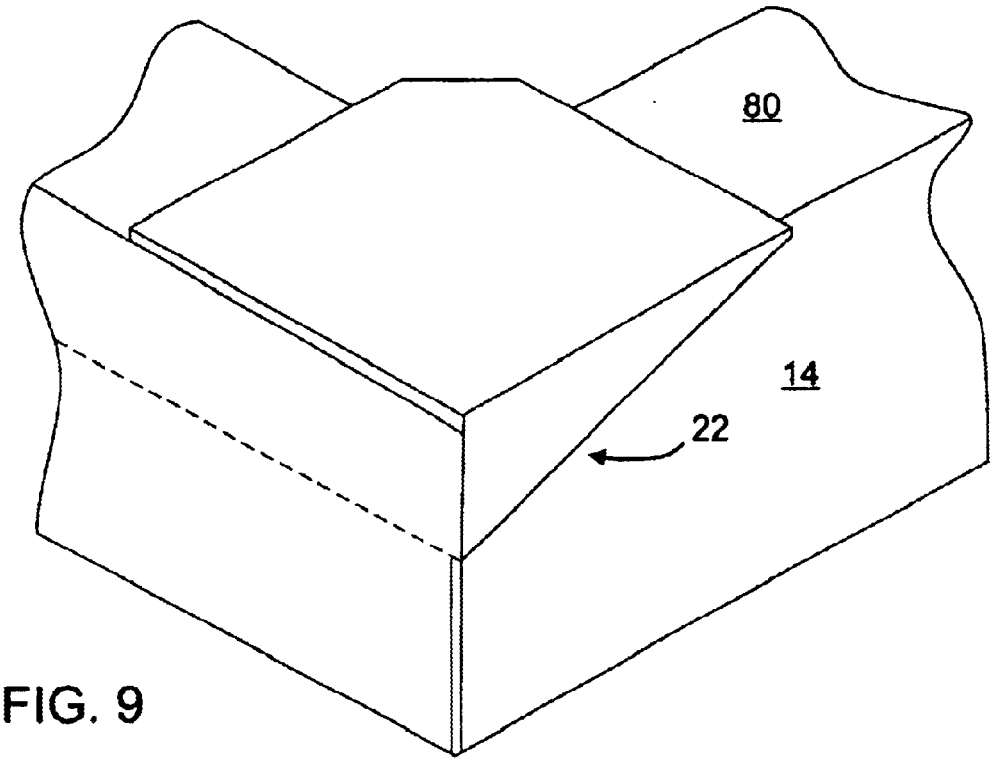
FIG. 9 is a perspective detail view of another alternative structure for a container according to the present invention.

FIG. 9 shows another detailed view of an alternative construction of a container according to the present invention. In the embodiment shown in FIG. 9, the container 10 is provided with side shoulder walls 80 extending inwardly from the side panels. FIG. 9 shows a side shoulder wall 80 extending inwardly from the first side panel 14. In this embodiment, the container 10 is further strengthened against sidewall deflection or bulge during shipment, and the side shoulder wall 80 provides another platform on which an above-stacked container can rest. The side shoulder walls 80 may be folded beneath the hinged platform structure 22 for shipment and may automatically spring open or be easily folded open when the hinged platform structure 22 is moved into an open position.

Figure 10:
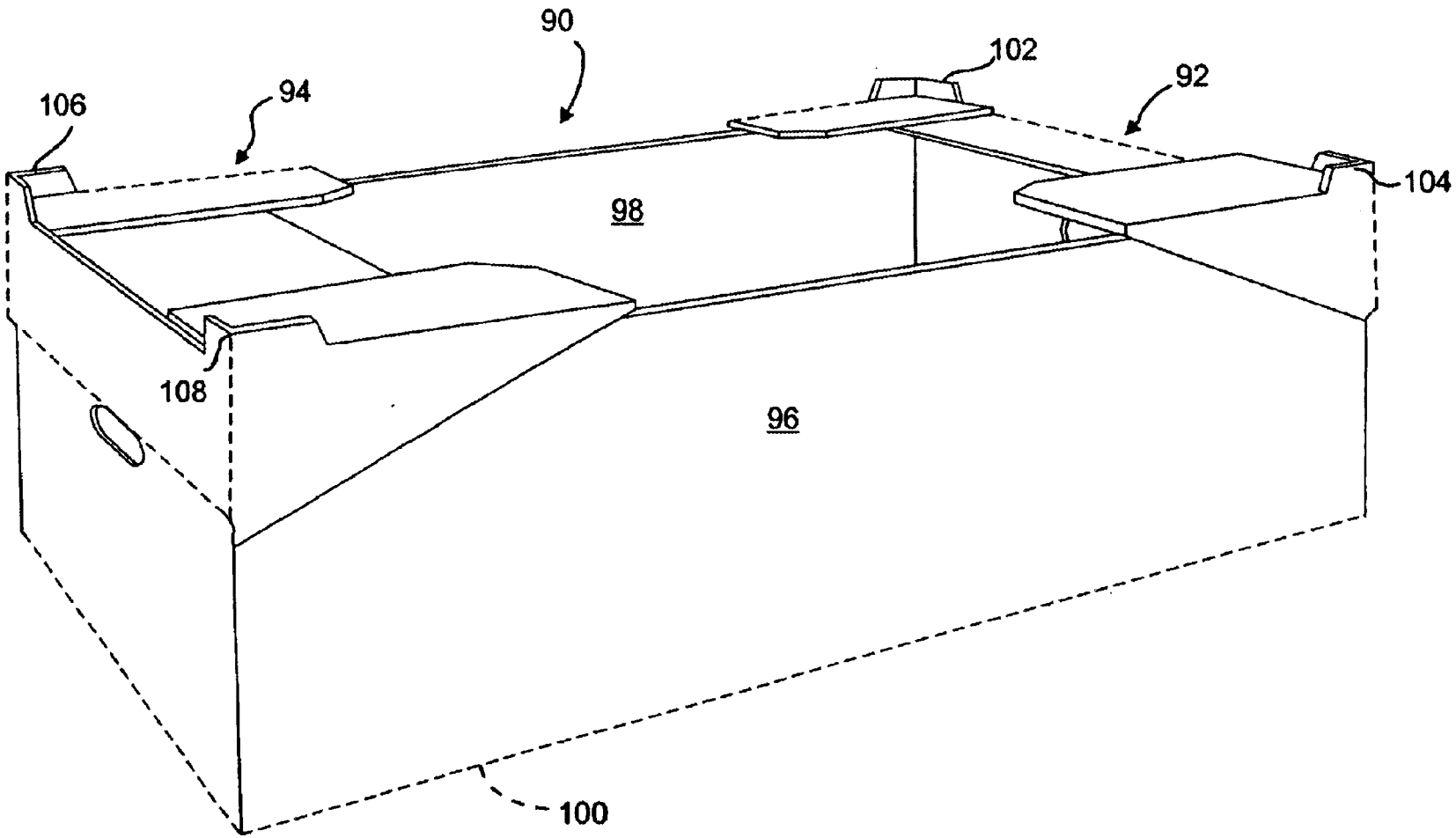
FIG. 10 is a side view of another alternative structure for a container according to the present invention.

Turning now to FIG. 10, a container 90 according to another embodiment of the present invention is shown. The container 90 includes first and second angled hinged platform structures 92, 94, first and second angled sidewalls 96, 98, and a bottom panel 100. The first and second angled hinged platform structures 92, 94 and first and second angled sidewalls 96, 98 are angled slightly outward relative to the bottom wall 100. The first and second angled hinged platform structures 92, 94 may also each include a pair of corner tabs 102, 104, 106, 108. The corner tabs 102, 104, 106, 108 are used to hold a container that is stacked on top of the present container 90. The angled platforms 92, 94 and the sidewalls 96, 98 allow the bottom panel of another container to easily fit inside the corner tabs 102, 104, 106, 108. The size of the angle is a function of the depth and width of the box.

While the present invention has been described with reference to one or more particular embodiments, those skilled in the art will recognize that many changes may be made thereto without departing from the spirit and scope of the present invention. For example, tear-tape may be provided along the hinges 30, 32 of the container to allow for easy removal of the hinged platform structures 22, 24 once the container 10 has reached its destination. Further, rather than having only two hinged platform structures 22, 24, the container 10 may be provided with four platform structures which articulate independently of each other. Each of these embodiments and obvious variations thereof is contemplated as falling within the spirit and scope of the claimed invention, which is set forth in the following claims.

What is claimed is:

1. A method of forming a container, comprising:

providing a blank cut and scored to provide:

a bottom panel;

first and second side panels extending outwardly from said bottom panel;

first and second minor interior wall flaps extending outwardly from said first side panel;

third and fourth minor interior wall flaps extending outwardly from said second side panel;

first and second end panels extending outwardly from said bottom panel;

a first end folding flap extending outwardly from said first end panel;

a second end folding flap extending outwardly from said second end panel;

first and second top platforms extending outwardly respectively from said first and second end folding flaps;

first and second side reinforcement flaps extending outwardly from said first end folding flap;

third and fourth side reinforcement flaps extending outwardly from said second end folding flap; and first, second, third, and fourth minor platform panels extending outwardly respectively from said first, second, third, and fourth side reinforcement flaps;

folding said first and second side panels upwardly into positions approximately orthogonal to said bottom panel;

folding said first, second, third, and fourth interior wall flaps inwardly into positions approximately orthogonal to said first and second side panels;

folding said first and second end panels upwardly into positions approximately orthogonal to said bottom panel;

folding said first and second top panels downwardly into positions approximately parallel to said bottom panel;

folding said first, second, third, and fourth side reinforcement flaps inwardly into positions approximately parallel with said first side panel and said second side panel; and folding said first, second, third, and fourth minor platform panels downwardly and inwardly into positions approximately parallel with said bottom panel.

2. The method of claim 1, further comprising placing adhesive between said first and second minor interior wall flaps and said first end panel and placing adhesive between said third and fourth minor interior wall flaps and said second end panel.

3. The method of claim 1, further comprising placing adhesive between said first and second minor platform panels and said first top platform and placing adhesive between said third and fourth minor platform panels and said second top platform.

4. A container comprising:

a bottom panel;

first and second side panels extending upwardly from said bottom panel;

first and second end panels extending upwardly from said bottom panel;

first and second minor interior wall flaps foldingly connected to said first side panel, extending perpendicularly to said bottom panel such that said first and second minor interior wall flaps are parallel to said first and second end panels;

third and fourth minor interior wall flaps foldingly connected to said second side panel, extending perpendicularly to said bottom panel such that said third and fourth minor interior wall flaps are parallel to said first and second end panels;

a first hinged platform structure attached to said first end panel along a first hinge offset below a top of said first and second minor interior wall flaps, said first hinged platform structure being integral with said first end panel, said first hinged platform structure comprises a first toy platform, a first end folding flap, and first and second side reinforcement flaps; and a second hinged platform structure attached to said second end panel along a second hinge offset below a top of said third and fourth minor interior wall flaps, said second hinged platform structure being integral with said second end panel, said second hinged platform structure comprises a second top platform, a second end folding flap, and third and fourth side reinforcement flaps, wherein said first hinged platform structure further comprises first and second minor platform panels, and said second hinged platform structure further comprises third and fourth minor platform panels, said first and second minor platform panels being above said first top platform and said third and fourth minor platform panels being above said second top platform.

5. The container of claim 1, further comprising a first handhold below said first hinge in said first end panel and a second handhold below said second hinge in said second end panel.

6. The container of claim 1, wherein said first hinged platform structure comprises a rollover panel having rollover tabs positioned to fit into rollover tab receptacles.

7. The container of claim 1, wherein said container comprises corrugated fiberboard and said first and second side panels contain vertically corrugated fiberboard.

8. The container of claim 1, wherein said first and second hinged platforms are adapted to be moved to an open position such that said first and second hinged platforms are angled away from the inside of said container.

9. The container of claim 8, wherein said first and second hinged platforms each include a pair of cornered tabs positioned to receive a bottom of a stacked container.

10. A blank for forming a container, said blank being a single flat piece of corrugated fiberboard cut and scored to provide:

a bottom panel;

first and second side panels extending outwardly from said bottom panel;

first and second end panels extending outwardly from said bottom panel;

a first end folding flap extending outwardly from said first end panel;

a second end folding flap extending outwardly from said second end panel;

first and second top platforms extending outwardly respectively from said first and second end folding flaps;

first and second side reinforcement flaps extending outwardly from said first end folding flap;

third and fourth side reinforcement flaps extending outwardly from said second end folding flap; and first, second, third, and fourth minor platform panels extending outwardly respectively from said first, second, third, and fourth side reinforcement flaps.

11. The blank of claim 10, further comprising first and second minor interior wall flaps extending from said first side panel and third and fourth minor interior wall flaps extending from said second side panel.

12. The blank of claim 10, further comprising a first hinge crease between said first end panel and said first end folding flap and a second hinge crease between said second end panel and said second end folding flap.

13. The blank of claim 12, further comprising a first handhold cut into said first end folding flap and a second handhold cut into said second end folding flap.

14. A container, comprising:

a bottom panel;

first and second side panels extending upwardly from said bottom panel;

first and second end panels extending upwardly from said bottom panel;

first and second minor interior wall flaps respectively extending inwardly from said first and second side panels and abutting said first end panel;

third and fourth minor interior wall flaps respectively extending inwardly from said first and second side panels and abutting said second end panel;

a first hinged platform structure attached to said first end panel along a first hinge offset from a top of said container, said first hinged platform structure comprising a first end folding flap, a first top platform extending inwardly from said first end folding flap, first and second minor platform panels positioned along the top of said first top platform, and first and second side reinforcement flaps extending from said first end folding flap respectively to said first and second minor platform panels;

a second hinged platform structure attached to said second end panel along a second hinge offset from a top of said container, said second hinged platform structure comprising a second end folding flap, a second top platform extending inwardly from said second end folding flap, third and fourth minor platform panels positioned along the top of said second top platform, and third and fourth side reinforcement flaps extending from said second end folding flap respectively to said third and fourth minor platform panels, and at least two stacking tabs extending upwardly from each of said side panels, wherein said first, second, third, and fourth minor platform panels are each provided with stacking tab cutouts aligned with said stacking tabs.

15. The container of claim 14, wherein said container is comprised of corrugated fiberboard and said first and second side panels contain vertically corrugated fiberboard.

16. The container of claim 15, wherein said first, second, third, and fourth minor interior wall flaps contain vertically corrugated fiberboard.

17. The container of claim 14, further comprising first and second side shoulder walls extending inwardly respectively from said first and second side panels.

18. A blank for forming a container, said blank being a single flat piece of corrugated fiberboard cut and scored to provide:

a bottom panel;

first and second side panels extending outwardly from said bottom panel;

first and second end panels extending outwardly from said bottom panel;

a first end folding flap extending outwardly from said first end panel;

a second end folding flap extending outwardly from said second end panel;

first and second minor interior wall flaps extending from said first side panel;

third and fourth minor interior wall flaps extending from said second side panel;

first and second top platforms extending outwardly respectively from said first and second end folding flaps;

first and second side reinforcement flaps extending outwardly from said first end folding flap;

third and fourth side reinforcement flaps extending outwardly from said second end folding flap; and first, second, third, and fourth minor platform panels extending outwardly respectively from said first, second, third, and fourth side reinforcement flaps.

19. A blank for forming a container, said blank being a single flat piece of corrugated fiberboard cut and scored to provide:

a bottom panel;

first and second side panels extending outwardly from said bottom panel;

first and second end panels extending outwardly from said bottom panel;

a first end folding flap extending outwardly from said first end panel;

a second end folding flap extending outwardly from said second end panel;

a first hinge crease between said first end panel and said first end folding flap;

a second binge crease between said second end panel and said second end folding flap;

a first handhold cut into said first end folding flap;

a second handhold cut into said second end folding flap;

first and second top platforms extending outwardly respectively from said first and second end folding flaps;

first and second side reinforcement flaps extending outwardly from said first end folding flap;

third and fourth side reinforcement flaps extending outwardly from said second end folding flap; and first, second, third, and fourth minor platform panels extending outwardly respectively from said first, second, third, and fourth side reinforcement flaps.

20. A container comprising:

a bottom panel;

first and second side panels extending upwardly from said bottom panel;

first and second end panels extending upwardly from said bottom panel;

first and second minor interior wall flaps foldingly connected to said first side panel, extending perpendicularly to said bottom panel such that said first and second minor interior wall flaps are parallel to said first and second end panels;

third and fourth minor interior wall flaps foldingly connected to said second side panel, extending perpendicularly to said bottom panel such that said third and fourth minor interior wall flaps are parallel to said first and second end panels;

a first hinged platform structure attached to said first end panel along a first hinge offset from a top of said first and second minor interior wall flaps, said first hinged platform structure being integral with said first end panel and comprising a first top platform, a first end folding flap, and first and second side reinforcement flaps; and a second hinged platform structure attached to said second end panel along a second hinge offset from a top of said third and fourth minor interior wall flaps, said second hinged platform structure being integral with said second end panel and comprising a second top platform, a second end folding flap, and third and fourth side reinforcement flaps wherein said first hinged platform structure further comprises first and second minor platform panels, and said second hinged platform structure further comprises third and fourth minor platform panels, said first and second minor platform panels being above said first top platform and said third and fourth minor platform panels being above said second top platform.

* * * * *